US009453706B1

(12) United States Patent
Crispin

(10) Patent No.: US 9,453,706 B1
(45) Date of Patent: Sep. 27, 2016

(54) LOW-PROFILE SIGHTING DEVICE

(71) Applicant: Leupold & Stevens, Inc., Beaverton, OR (US)

(72) Inventor: Quint Crispin, Beaverton, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 14/956,936

(22) Filed: Dec. 2, 2015

Related U.S. Application Data

(60) Provisional application No. 62/086,643, filed on Dec. 2, 2014.

(51) Int. Cl.

| | |
|---|---|
| ***F41G 1/06*** | (2006.01) |
| ***F41G 1/34*** | (2006.01) |
| ***F41G 1/38*** | (2006.01) |
| ***F41G 1/26*** | (2006.01) |

(52) U.S. Cl.
CPC . *F41G 1/06* (2013.01); *F41G 1/26* (2013.01); *F41G 1/38* (2013.01)

(58) Field of Classification Search
CPC ..... F41G 1/00; F41G 1/01; F41G 1/06; F41G 1/08; F41G 1/16; F41G 1/26; F41G 1/30; F41G 1/32; F41G 1/42; F41G 1/345
USPC ..... 42/113, 115, 122, 130
See application file for complete search history.

(56) References Cited

U.S. PATENT DOCUMENTS 1,911,770 A * 5/1933 Redfield ..... F41G 1/16 42/137
3,230,627 A * 1/1966 Rickert ..... F41G 1/345 356/247
3,678,590 A * 7/1972 Hayward ..... F41G 1/345 356/247
3,942,256 A * 3/1976 Khaidurov ..... F41G 1/26 42/137
5,068,969 A * 12/1991 Siebert ..... F41A 17/22 362/110
5,369,888 A * 12/1994 Kay ..... F41G 1/30 356/252
5,467,552 A * 11/1995 Cupp ..... F41G 1/26 42/125
5,735,070 A * 4/1998 Vasquez ..... F41G 1/345 42/1.02
5,887,352 A * 3/1999 Kim ..... F41G 1/08 42/144
5,933,972 A * 8/1999 Springer, Jr. ..... F41G 1/01 42/133
6,327,806 B1 12/2001 Paige et al.
6,360,469 B1 * 3/2002 Mikuta ..... F41A 17/066 42/70.11
6,490,060 B1 12/2002 Tai et al.
7,069,685 B2 7/2006 Houde-Walter
7,721,481 B2 5/2010 Houde-Walter
7,796,329 B2 9/2010 Dobschal et al.
7,916,290 B2 3/2011 Koehler
8,082,688 B2 12/2011 Elpedes et al.

(Continued)

*Primary Examiner* — Bret Hayes
*Assistant Examiner* — Derrick Morgan
(74) *Attorney, Agent, or Firm* — Stoel Rives LLP

(57) ABSTRACT

An aiming device having for use with small weapons, such as pistols. The device includes a body mountable to the pistol, the body having an elongate upper section and a rear section projecting downwardly from the elongate upper section. When the body is mounted, the upper section is adjacent the upper surface of the pistol slide and the rear section is positioned adjacent the rear end of the slide and predominantly below the upper surface of the slide. The aiming device includes a display device carried by the rear section of the body, the display device operable to generate an aiming mark that is displayed via an optical element in sufficiently close proximity to the upper surface of the slide such that the aiming mark appears co-witnessed with a front iron sight of the pistol to a shooter viewing the aiming mark through the optical element while aiming.

16 Claims, 3 Drawing Sheets

(56) References Cited

U.S. PATENT DOCUMENTS

| | | | | |
|---|---|---|---|---|
| 8,117,780 | B2 | 2/2012 | Matthews et al. | |
| 8,448,373 | B2 * | 5/2013 | Matthews | F41A 33/00 42/114 |
| 8,714,072 | B1 * | 5/2014 | Villarreal | F41G 3/165 42/130 |
| 8,997,391 | B2 * | 4/2015 | Rozic | F41G 1/02 42/111 |
| 9,010,012 | B2 | 4/2015 | Matthews et al. | |
| 9,285,186 | B1 * | 3/2016 | Di Veroli | F41G 1/06 |
| 2005/0057808 | A1 | 3/2005 | Houde-Walter | |
| 2006/0164704 | A1 * | 7/2006 | Sieczka | F41G 1/30 359/15 |
| 2006/0230665 | A1 * | 10/2006 | Narcy | G02B 23/12 42/123 |
| 2009/0113778 | A1 * | 5/2009 | Paterson | F41G 1/16 42/90 |
| 2010/0095578 | A1 | 4/2010 | Elpedes et al. | |
| 2010/0175297 | A1 * | 7/2010 | Speroni | F41G 1/35 42/114 |
| 2013/0145666 | A1 * | 6/2013 | Eriksson | F41G 1/30 42/1.06 |
| 2013/0188180 | A1 * | 7/2013 | Jakob | F41G 1/345 356/248 |
| 2013/0283660 | A1 * | 10/2013 | Matthews | F41G 1/30 42/113 |
| 2015/0198415 | A1 * | 7/2015 | Campean | F41G 1/16 42/137 |
| 2015/0198421 | A1 * | 7/2015 | Crispin | F41G 11/006 42/126 |
| 2015/0226521 | A1 * | 8/2015 | Patterson | F41G 1/345 42/111 |
| 2015/0241175 | A1 * | 8/2015 | Wolf | F41G 1/26 42/124 |
| 2016/0010949 | A1 * | 1/2016 | Teetzel | F41G 1/35 42/115 |
| 2016/0102942 | A1 * | 4/2016 | Abo | F41G 1/06 42/132 |

* cited by examiner

LOW-PROFILE SIGHTING DEVICE

RELATED APPLICATION DATA

This application is a nonprovisional of and claims the benefit under 35 U.S.C. §119(e) of U.S. Provisional Patent Application No. 62/086,643, filed Dec. 2, 2014, the disclosure of which is incorporated by reference herein in its entirety.

TECHNICAL FIELD

The field of the present disclosure relates generally to optical sighting devices, and, in particular, to such optical sighting devices having a low-profile configuration for use with small weapons, such as handguns and other arms.

BACKGROUND

Miniature reflex sights, also commonly known as mini red-dot sights, are non-magnifying reflector sights commonly used with handguns and small armaments such as rifles and crossbows. Reflex sights may also be used for other aiming purposes, such as on a finder scope for use with a telescope. Typically, reflex sights include a partially reflecting transparent element, such as a lens or flat glass element, that the user looks through to view a target and an illuminated aiming mark or reticle pattern that is superimposed on the field of view. In a reflex sight utilizing a reflecting lens element, the aiming mark is typically generated by a small light-emitting diode (LED) at the focal point of the lens, which is selectively reflective to the wavelength of the illumination. In reflex sights including a flat glass element, the aiming mark is generated by an illumination source directed through collimating optics toward the flat glass element. U.S. Pat. No. 6,327,806 of Paige describes a reflex sight and a method of manufacturing its lens element. Other similar reflex sights are described in U.S. Pat. No. 8,082,688 of Elpedes et al. and U.S. Pat. No. 7,916,290 of Koehler.

Generally, miniature reflex sights offer a low-profile design optimized for use with handguns and small armaments since conventional reflex sights are typically too large to use effectively with such small arms. The present inventor, however, has recognized a need for an improved miniature reflex sight with a more compact profile to enhance concealment options for the handgun. In addition, the present inventor has recognized a need for such an improved design that allows the front iron sight of the handgun to be cowitnessed with the optical element of the body of the reflex sight to allow it to serve as secondary sights in case the reflex sight fails or loses power.

Additional aspects and advantages will be apparent from the following detailed description of example embodiments, which proceeds with reference to the accompanying drawings.

DETAILED DESCRIPTION OF EXAMPLE EMBODIMENTS

Figure 1:
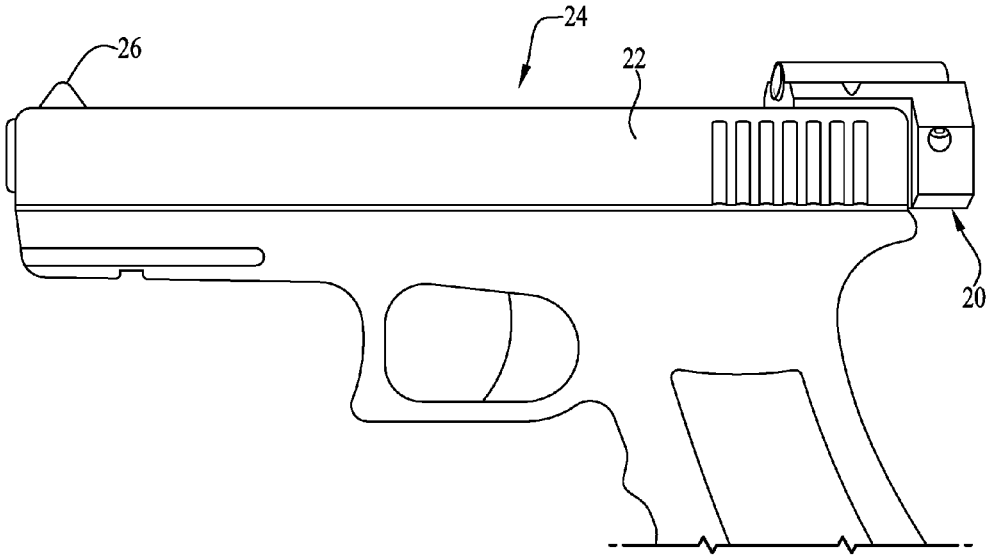
FIG. 1 is an elevation view of a miniature reflex sight mounted to a pistol, according to one embodiment.

This section describes particular embodiments and their detailed construction and operation. The embodiments described herein are set forth by way of illustration only and not limitation. Throughout the specification, reference to "one embodiment," "an embodiment," or "some embodiments" are not necessarily all referring to the same embodiment. The described features, structures, characteristics, and methods of operation may be practiced in isolation or combined in any suitable manner, and can be practiced without one or more of the specific details or with other methods, components, materials, or the like. In other instances, well-known structures, materials, or methods of operation are not shown or not described in detail to avoid obscuring more pertinent aspects of the embodiments. It should be understood that the foregoing written description and the embodiments in the figures illustrating use of the reflex sight with a pistol are merely intended to demonstrate one example embodiment. As noted previously, the reflex sight with the features described herein may be used with other suitable small firearms and armaments. In addition, in other embodiments, a different sighting device may be used, such as a holographic sight or other suitable sight.

FIGS. 1-6 collectively illustrate example embodiments of a miniature reflex sight 20 mounted to a slide 22 of a pistol 24, the reflex sight 20 seated on a rear portion of the pistol 24 and having a low-profile configuration. With general reference to FIGS. 1-6, reflex sight 20 includes a body 30 that supports an optical element 40 and serves as a housing for electronics and other components of the reflex sight 20. By positioning the electronics and adjustment mechanisms of the reflex sight 20 in a lower portion of the body 30 and behind the slide 22 of the pistol 24, the overall profile of the reflex sight 20 is reduced to minimize the added bulk to the pistol 24 when the reflex sight 20 is mounted thereon. In addition, the low-profile configuration allows use of front iron sight 26 as an alternate sighting option when viewed through the optical element 40 of the reflex sight 20. Additional details of these and other embodiments are described below with particular reference to FIGS. 2-6.

Figure 2:
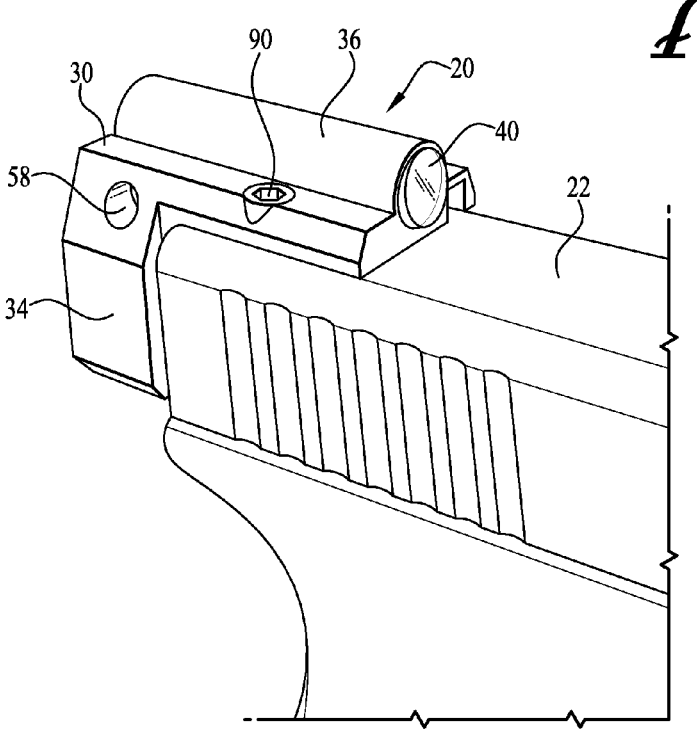
FIG. 2 is an enlarged front perspective view of the reflex sight of FIG. 1.
Figure 3:
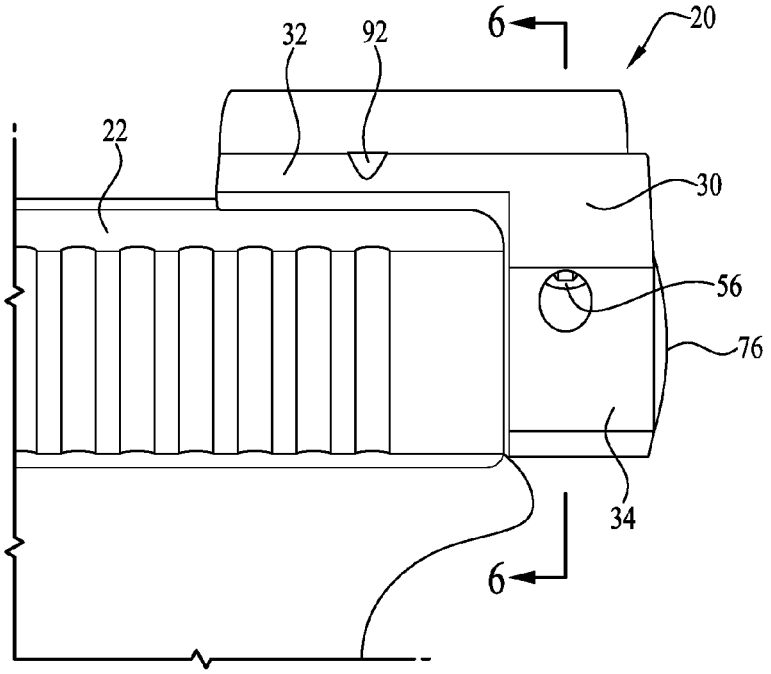
FIG. 3 is an enlarged elevation view of the reflex sight of FIG. 1.

FIGS. 2 and 3 illustrate an enlarged front perspective view and an enlarged elevation view, respectively, of the reflex sight 20 mounted to the pistol 24. With reference to FIGS. 2 and 3, the body 30 of the reflex sight 20 is generally L-shaped with an elongate upper section 32 and a rear section 34 extending downwardly from a rear portion of the elongate upper section 32. The elongate upper section 32 supports a tubular frame 36 extending in a longitudinal direction along the elongate upper section 32. The reflex sight 20 includes an optical element in the form of a non-magnifying lens 40 mounted in a generally upright position at a forward portion of the frame 36, the lens 40 providing a viewing window for a target field of view (see FIGS. 4-6). As is described below in further detail, the body 30 houses an aiming mark display 44 (such as a miniature light-emitting diode (LED) assembly as in FIGS. 5-6) positioned at a focal point rearward of lens 40 and within rear section 34 of the body 30. During use of the reflex sight 20, light emitted from the aiming mark display device 44 is reflected rearwardly as collimated light toward the user's eye by a dichroic reflection layer or coating of lens 40 so that the user perceives the reflected light as an illuminated aiming mark 46 (such as a red dot as in FIG. 4) superimposed on the field of view at infinite distance. As is further described in detail below with reference to FIG. 4, when the reflex sight 20 is mounted to a rear portion of the slide 22 of the pistol 24, the low-profile design of the body 30 allows a shooter to view the front iron sight 26 through the non-magnifying lens 40 as a backup sighting device. The front iron sight 26 is typically a sight post mounted at or formed in the muzzle end of the barrel or slide 22.

Figure 5:
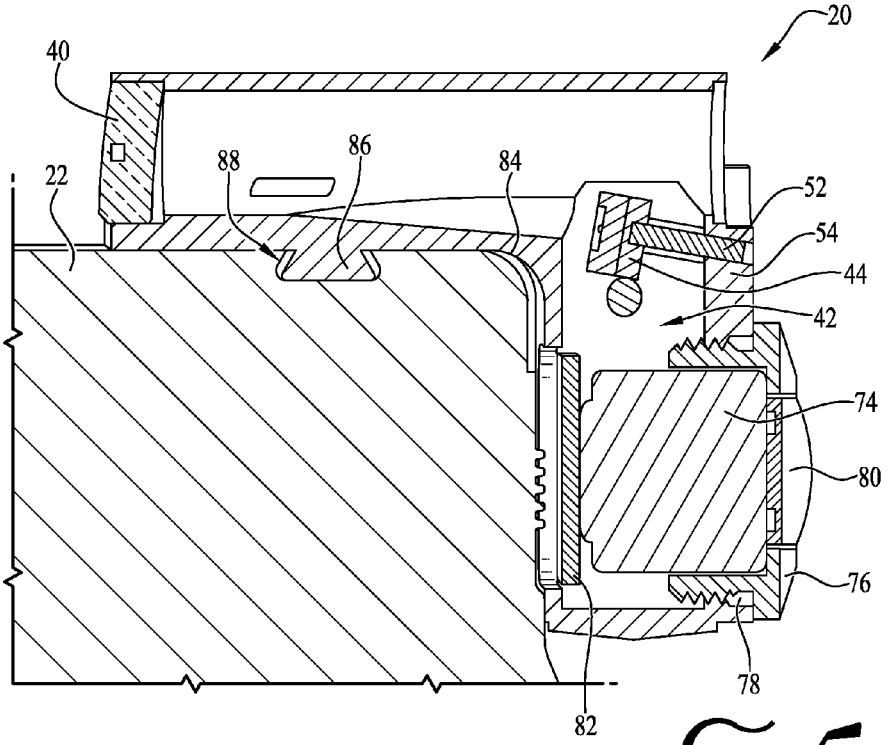
FIGS. 5 and 6 are cross-section views of the reflex sight of FIG. 1, illustrating an arrangement of an aiming mark display device and adjustment mechanisms therefor.
Figure 6:
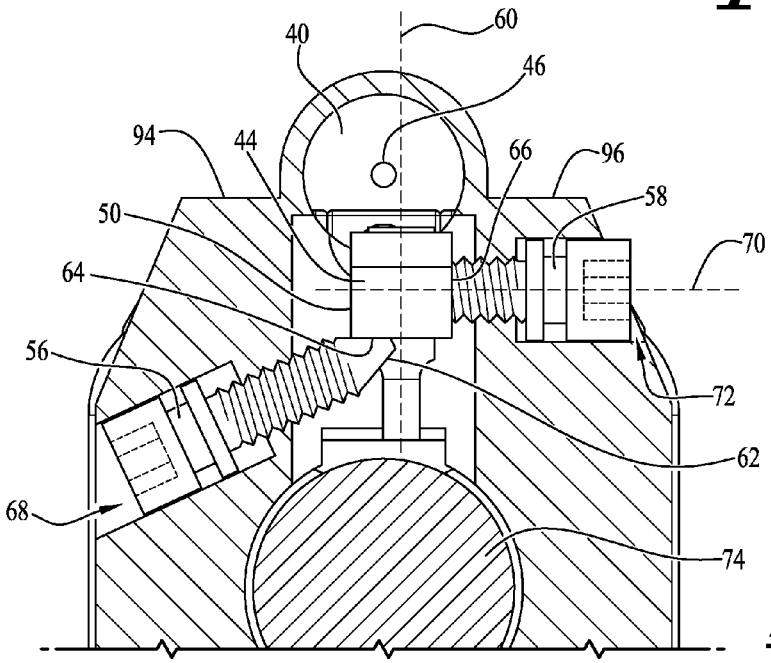

With particular reference to the cross-section views of FIGS. 5 and 6, the following section describes details regarding an example arrangement of electronics and other components that drive the reflex sight 20. With reference to FIGS. 5 and 6, the rear section 34 of the body 30 is positioned behind the slide 22 of the pistol 24 and includes a compartment 42 that houses the aiming mark display device (e.g., LED assembly) 44 and a button cell electric storage battery 74 for powering electronics that drive the aiming mark display device 44. In this configuration, the aiming mark display device 44 generally sits behind the slide 22 of the pistol 24 when the reflex sight 20 is mounted to the pistol 24. The aiming mark display device 44 is oriented toward the lens 40 so as to have a clear optical path for illumination generated by the aiming mark display device 44 to reach lens 40 and allow the shooter to view the illuminated aiming mark 46 while looking through the optical lens of the reflex sight 20.

In the illustrated embodiment, the aiming mark display device 44 is approximately aligned with a top plane of the slide 22, with the top plane of the slide 22 intersecting the aiming mark display device 44. In other embodiments, the aiming mark display device 44 may instead be positioned entirely below the top plane of the slide 22. In such embodiments, the body 30 may extend out further behind the slide 22 so that the aiming mark display device 44 has a clear optical path to reach the lens 40.

As illustrated in FIG. 6, the aiming mark display device 44 may be supported or housed within a carrier 50 in the compartment 42. To fix the parallel setting of the reflex sight 20, a flexible biasing member 52, such as a plastic rod or spring, may be interposed between the carrier 50 and a rear wall 54 of the body 30, with the biasing member 52 extending forwardly from the rear wall 54 and abutting or sitting against a rear portion of the carrier 50. As explained in further detail below, contact between the biasing member 52 and the carrier 50 also urges the carrier 50 (and the aiming mark display device 44 housed therein) toward an elevation adjustment screw 56 and a windage adjustment screw 58 so that the carrier 50 maintains consistent contact with the screws 56, 58. The screws 56, 58 are operable to adjust a position of the aiming mark display device 44 along a first axis of motion 60 and a second axis of motion 70 to allow the user to sight-in or "zero" the sight by repositioning the aiming mark 46 to align with the point of impact of the pistol 24 at a predetermined sighted-in range, and/or to adjust for ranges different from the sighted-in range or for environmental and other shooting conditions as needed. The following describes an example operation of the screws 56, 58 for repositioning the aiming mark 46.

With particular reference to FIGS. 5 and 6, the elevation adjustment screw 56 is rotatably supported on the rear section 34 of the body 20 and extends into the compartment 42. Preferably, to minimize size requirements of the reflex sight 20, the elevation adjustment screw 56 is positioned underneath the carrier 50 and oriented at an angle, which may range between 30 and 60 degrees relative to the first axis of motion 60. To provide a flat surface for supporting the aiming mark display device 44 and the carrier 50, the elevation adjustment screw 56 includes a conical end 62 having a tapered surface 64. In this configuration, because the screw 56 is angled, the tapered surface 64 effectively provides a flat surface when the elevation adjustment screw 56 is received in the compartment 42. The flat surface allows the carrier 50 to bear against the elevation adjustment screw 56 and smoothly ride upwardly or downwardly along the first axis of motion 60 when the adjustment screw 56 is rotated.

As mentioned previously, reflex sight 20 further includes a windage adjustment screw 58 for effecting horizontal movement of the carrier 50 and the aiming mark display device 44 along a second axis of motion 70 orthogonal to the first axis of motion 60. The windage adjustment screw 58 is rotatably supported on the rear section 34 and extends horizontally into the compartment 42 generally along the second axis of motion 70. The windage adjustment screw 58 includes a planar end 66 that abuts a side wall of the carrier 50, the screw 58 being operable to drive the carrier 50 and the aiming mark display device 44 along the second axis of motion 70. When the windage adjustment screw 58 is rotated, the carrier 50 and aiming mark display device 44 ride on the tapered surface 64 of the elevation adjustment screw 56 to move the aiming mark display device 44 along the second axis of motion 70.

In one embodiment, windage and elevation adjustment screws 56, 58 each extend through unthreaded bores 68, 72, respectively, in body 30, so that the heads of the adjustment screws 56, 58 are seated in counterbores of the bores 68, 72 and the ends 62, 66 of the screws 56, 58 extend into the compartment 42 and against the carrier 50. In some embodiments, the adjustment screws 56, 58 may be retained in the bores 68, 72 by E-clips (not shown) that may be clipped to a shoulder groove (not shown) of screws 56, 58 and abutting an internal wall of the compartment 42. In addition, O-rings (not shown) or other sealing structures may be used to seal the compartment 42 and urge the adjustment screws 56, 58 outwardly to take up slop.

With particular reference to FIG. 5, the compartment 42 also houses the button cell 74 that powers the illumination electronics of the reflex sight 20 to drive the aiming mark display device 44. In some embodiments, the button cell 74 may be accessed and replaced via a threaded cap 76 that covers an opening (not numbered) to compartment 42 located on the lower section 34 of the body 30. When closed, lid 76 is preferably sealed to body 30 by an O-ring or other suitable sealing member (not shown) that is compressed between lid 76 and a wall of the body 30. For example, in one embodiment, the O-ring is preferably fitted in a channel 78 encircling lid 76 to prevent moisture and debris from entering the compartment 42 when lid 76 is closed.

In some embodiments, the cap 76 may include a button switch 80 formed of an elastomeric or plastic material that is manually depressible to close a switch or circuit to control illumination settings and features, such as light intensity or shape, of the aiming mark or other reticle pattern generated by the aiming mark display device 44 of the reflex sight 20. The reflex sight 20 includes a circuit board 82 that may be positioned behind or underneath the button cell 74. The circuit board 82 includes a dome switch or other switch membrane (not shown) that may be activated when the button switch 80 is depressed. For example, in one embodiment, depressing the button switch 80 moves the button cell 74 toward the circuit board 82 to activate the dome switch. When the button switch 80 is released, a wave spring or other biasing element exerts a force onto the button cell 74 to automatically return the button switch 80 to its initial position. In this fashion, the button switch 80 may operate as a mode switching tool to allow a user to cycle through various illumination features of the reflex sight 20.

For example, in one embodiment, the user may cycle through various illumination settings by manually depressing the button switch 80 multiple times until a desired light intensity level is obtained. In some embodiments, depressing the button switch 80 may cycle through an ON setting, a high intensity setting, a medium intensity setting, a low intensity setting, and an OFF setting. In other embodiments, the button switch 80 may instead be depressed to toggle between an automatic mode and a manual mode to control illumination of the aiming mark or reticle pattern. In an automatic mode, an illumination sensing system (or other light sensing mechanism) may measure ambient light and automatically determine and set an appropriate illumination level (e.g., high illumination, medium illumination, or low illumination) for the aiming mark based on the measured ambient light.

In some instances, the dome switch may be inadvertently activated, such as by recoil forces after firing the pistol 24 or inadvertent brushing or touching of the button switch 80 that may drive the button cell 74 onto the circuit board 82. To minimize inadvertent activation of the illumination features of the reflex sight 20, the circuit board may include a microcontroller or microprocessor (not shown) configured to distinguish an inadvertent activation of the dome switch from an intentional activation. For example, in some embodiments, the microcontroller may require that the button switch 80 is held down for a short period of time before the illumination setting is toggled. For example, a user may need to hold the button switch 80 for two seconds to toggle illumination settings. In this fashion, a short-lived activation of the dome switch, such as may be caused by recoil forces or incidental contact with the button switch 80, will not change the illumination settings of the reflex sight 20.

In other embodiments, the microcontroller may be programmed to reset the illumination setting after a shot is fired to ensure that the reflex sight 20 maintains the same illumination conditions for subsequent shots. For example, if the reflex sight 20 is set at a low illumination setting, and a shot is fired, the recoil may activate the dome switch and toggle the illumination to a medium illumination setting. In such instances, the microcontroller may reset the illumination back to the low illumination setting so that shooter may fire again with the reflex sight 20 set on low illumination.

The reflex sight 20 may be mounted onto the pistol 24 using anyone of a variety of suitable mounting systems and techniques. For example, in some embodiments, an underside 84 of the elongate upper section 32 of the body 30 may include a tail 86 formed thereon. The tail 86 is shaped and dimensioned to slidably fit into a lateral dovetail mounting slot 88 formed on the slide 22 of the pistol 24 so that the reflex sight 20 may be mounted and dismounted as desired by sliding the tail 86 laterally into and out of the dovetail slot 88. In some embodiments, the body 30 may further include slots or bores 90, 92 (see FIGS. 2 and 3, respectively) formed on either side of the tubular frame 36. The bores 90, 92 receive mounting screws/fasteners to further secure the reflex sight 20 to the slide 22 and prevent inadvertent movement of the reflex sight 20 due to recoil or other external forces.

In other embodiments, the tail 86 may be a separate component from the body 30. The tail 86 may include two threaded holes on a top surface thereof and slide into the lateral dovetail slot 88 of the slide 22. Once the tail 86 is in position, screws may be inserted through the bores 90, 92 on the body 30 and thread into the tail 86 to secure the body 30 to the slide 22. It should be understood that in other embodiments, the underside 84 of the reflex sight 20 may include different mounting features and the slide 22 may include corresponding mounts to receive the reflex sight 20. For example, in other embodiments, the slide may include a rail, a socket, a hole, a pin, or other suitable mounts for receiving the reflex sight 20.

Figure 4:
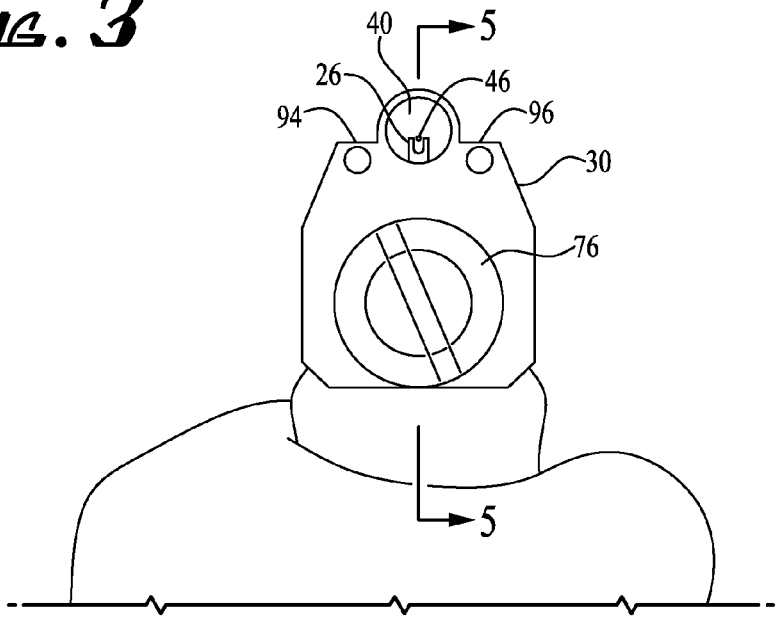
FIG. 4 illustrates a rear view of the reflex sight of FIG. 1, illustrating an aiming mark co-witnessed with a front iron sight of the pistol, according to one embodiment.

As mentioned previously, positioning the electronics and adjustment mechanisms of the reflex sight 20 in the lower section 34 of the body 30 provides for a low-profile compact reflex sight 20. With particular reference to FIG. 4, when the reflex sight 20 is mounted to the slide 22 of the pistol 24, the low-profile arrangement of the reflex sight 20 allows for the illuminated aiming mark 46 of the reflex sight 20 to be cowitnessed with the front iron sight 26 of the pistol 24. In such a configuration, if the reflex sight 20 is not functional (e.g., the electronics short out, the battery drains, or the reflex sight 20 otherwise fails), a shooter may view the front iron sight 26 through the optical lens 40 of the reflex sight 20 to aim at a target. In this arrangement, a shooter does not have to remove the non-functioning reflex sight 20 to continue using the pistol 24, or change his or her head position to view the front iron sight 26 beyond the reflex sight 20. Instead, the shooter simply uses the front iron sight 26, as viewed through the optical lens 40 of the reflex sight 20, as an alternate sighting system. The following describes additional details of this embodiment.

With reference to FIGS. 4 and 6, the body 30 includes a pair of integrally formed shoulders 94, 96 bordering either side of the tubular frame 36. When the body 30 is mounted to the slide 22 of the pistol 24, the shoulders 94, 96 serve as a rear iron sight for aligning the front iron sight 26 (as viewed through the optical element 40 of the reflex sight 20). The iron sights 26, 94, 96 may then cowitness the illuminated aiming mark 46 of the reflex sight 20. Thus, when the front iron sight 26 is aligned with the rear iron sight (shoulders 94, 96), the illuminated aiming mark 46 appears coincident with the horizontal end of the front iron sight 26 when the shooter looks through the optical element 40. The iron sights 26, 94, 96 may be cowitnessed with the illuminated mark 46 such that the front iron sight 26 appears aligned with the shoulders 94, 96 when the front iron sight 26 is visible only within a lower one-third of the optical element 40. In this configuration, the front iron sight 26 obscures a smaller portion of the field of view through the optical element 40 to provide the shooter with a more open field of view and improved situational awareness.

In the embodiments of FIGS. 1-6, the miniature reflex sight is illustrated and described as a component separate from the pistol, where the miniature reflex sight is mounted to the slide of a pistol via a plurality of fasteners and other mounting features. In other embodiments, the miniature reflex sight, having the same or similar components as those described with reference to FIGS. 1-6 arranged in the same or similar configuration, may instead be integrally formed as part of the slide of the pistol. In particular, the L-shaped body 30 may be combined with the slide. For example, with general reference to FIG. 1, the tubular frame 36 may extend upwardly from the upper surface of the slide 22, with the optical element 40 mounted in a generally upright position at a forward portion of the frame 36 to provide a viewing window for a target field of view. In addition, the compartment 42 that houses the aiming mark display 44, the adjustment screws 56, 58, and the other components of the reflex sight 20 as described in FIGS. 5-6, may instead be formed as part of a rear portion of the slide 22, the compartment containing the same components in the same or similar configuration as described previously. For example, the aiming mark display device 44 may be positioned within the compartment in the rear portion of the slide and oriented toward the lens 40 so as to have a clear optical path for illumination generated by the aiming mark display device 44 to reach lens 40 and allow the shooter to view the illuminated aiming mark 46 while looking through the optical lens of the reflex sight 20. Preferably, the aiming mark display device 44 is positioned at least partially underneath a plane parallel to the upper surface of the slide (and underneath the optical element 40) such that the plane intersects the aiming mark display device 44, wherein the aiming mark reflected in the optical element of the tubular frame is co-witnessed with a front iron sight of the pistol.

In some embodiments, to conserve space and minimize the length of the slide, the battery 74 and the button switch 80 may be positioned at a side of the slide (rather than at a rear portion of the slide). It will be understood that in other embodiments, other minor modifications may be made to the placement of the electronics and other components to integrate the miniature reflex sight to the slide of the firearm.

It is intended that subject matter disclosed in any one portion herein can be combined with the subject matter of one or more other portions herein as long as such combinations are not mutually exclusive or inoperable. In addition, many variations, enhancements and modifications of the concepts described herein are possible.

It will be obvious to those having skill in the art that many changes may be made to the details of the above-described embodiments without departing from the underlying principles of the invention. The scope of the present invention should, therefore, be determined only by the following claims.

The invention claimed is:

1. An aiming device for a projectile weapon having a front iron sight positioned proximate a forward end of the projectile weapon and a slide with an upper surface and a rear end surface, the projectile weapon including a longitudinal axis extending through a barrel thereof, the aiming device comprising:

a generally L-shaped body having an elongate upper section with a first end and a second end opposite the first end, and a rear section projecting downwardly from the second end of the upper section such that the body is mountable to the projectile weapon with the first end of the upper section adjacent the upper surface and positioned in front of the rear end surface of the slide and with the second end of the upper section and the rear section positioned behind the rear end surface of the slide, the rear section predominantly below the upper surface of the slide and extending downwardly and intersecting the longitudinal axis of the projectile weapon;

an optical element supported on the upper section of the body and positioned in front of the rear end surface of the slide;

an aiming mark display device carried by the body and positioned behind the rear end surface of the slide when the aiming device is mounted to the projectile weapon, the aiming mark display device operable to generate an aiming mark that is displayed via the optical element in sufficiently close proximity to the upper surface of the slide such that the aiming mark appears co-witnessed with the front iron sight to a shooter viewing the aiming mark through the optical element while aiming the projectile weapon.

2. The aiming device of claim 1, further comprising:

an elevation adjustment screw rotatably supported on the body, the elevation adjustment screw supporting the aiming point display device and operable to adjust a position of the aiming point display device along a first axis; and a windage adjustment screw rotatably supported on the body and bearing against the aiming mark display device, the windage adjustment screw operable to adjust a position of the aiming mark display device along a second axis orthogonal to the first axis.

3. The aiming device of claim 2, wherein the elevation adjustment screw faces the aiming mark display device and is arranged at an angle relative to the first axis.

4. The aiming device of claim 3, wherein the elevation adjustment screw includes an end having a tapered surface, wherein the tapered surface supports the aiming mark display device.

5. The aiming device of claim 1, wherein the aiming device is a reflex sight and the aiming mark generated by the aiming mark display device is reflected in the optical element of the body.

6. The aiming device of claim 1, the elongate upper section further including a circular or tubular frame, wherein the optical element is seated within the frame, and wherein the front iron sight is viewable through the optical element.

7. The aiming device of claim 1, further comprising a carrier housing the aiming mark display device and a flexible body extending from an interior surface of the rear section to a back surface of the carrier, the flexible body urging the carrier toward the elevation adjustment screw and the windage adjustment screw to maintain contact therewith.

8. The aiming device of claim 1, further comprising a battery compartment formed within the rear section of the body, the battery compartment sized to receive a battery for powering the aiming mark display device.

9. The aiming device of claim 8, further comprising a battery cap threadably coupled to the rear section of the body, the battery cap being removable for accessing the battery compartment.

10. The aiming device of claim 1, further comprising a tail formed on a bottom surface of the elongate upper section for mounting the body to a slot formed on the slide of the projectile weapon.

11. The aiming device of claim 1, wherein the aiming mark display device is positioned at least partially underneath a plane parallel to the upper surface of the slide when the body is mounted on the projectile weapon such that the plane intersects the aiming mark display device.

12. The aiming device of claim 1, wherein the aiming mark display device is positioned entirely underneath a plane parallel to the upper surface of the slide when the body is mounted on the projectile weapon.

13. The aiming device of claim 1, wherein the rear section of the body abuts the rear end surface of the slide when the body is mounted to the projectile weapon.

14. The aiming device of claim 1, wherein the optical element is seated at a front portion of the first end of the body.

15. The aiming device of claim 1, wherein the second end of the upper section of the body includes a first shoulder and a second shoulder formed thereon, the first and second shoulders spaced apart from one another and aligned relative to the optical element such that the first and second shoulders serve as a rear iron sight for the projectile weapon.

16. The aiming device of claim 15, wherein the first and second shoulders are aligned relative to the front iron sight such that the aiming mark appears co-witnessed with the front iron sight and the first and second shoulders to a shooter viewing the aiming mark through the optical element while aiming the projectile weapon.

* * * * *